US009482986B2

(12) United States Patent
Sakurai et al.

(10) Patent No.: US 9,482,986 B2
(45) Date of Patent: Nov. 1, 2016

(54) MEMBER FOR ELECTROPHOTOGRAPHY, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Yuji Sakurai, Susono (JP); Kazutoshi Ishida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/045,581

(22) Filed: Feb. 17, 2016

(65) Prior Publication Data

US 2016/0252842 A1 Sep. 1, 2016

(30) Foreign Application Priority Data

Feb. 27, 2015 (JP) ..... 2015-039125

(51) Int. Cl.
*G03G 15/08* (2006.01)

(52) U.S. Cl.
CPC ..... *G03G 15/0808* (2013.01)

(58) Field of Classification Search
None
See application file for complete search history.

(56) References Cited

U.S. PATENT DOCUMENTS 5,220,383 A * 6/1993 Enoki ..... G03G 15/0806 399/285
5,741,616 A * 4/1998 Hirano ..... G03G 15/0818 399/286
6,725,002 B2 4/2004 Sakurai et al.
7,201,967 B2 4/2007 Sakurai et al.
7,798,948 B2 9/2010 Kawamura et al.
7,979,004 B2 7/2011 Tanaka et al.
8,600,273 B2 12/2013 Yamada et al.
8,660,472 B2 2/2014 Kurachi et al.
8,706,011 B2 4/2014 Anan et al.
8,768,226 B2 7/2014 Koyanagi et al.
8,774,677 B2 7/2014 Sakurai et al.
8,798,508 B2 8/2014 Yamada et al.
8,837,985 B2 9/2014 Ishida et al.

(Continued)

FOREIGN PATENT DOCUMENTS

EP 2 051 142 4/2009
JP 8-286497 A 11/1996
JP 2005-331782 12/2005

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

Provided is a member for electrophotography that can achieve both an improvement in toner-conveying force under high temperature and high humidity, and excellent charge-providing performance for a toner, at high levels. The member for electrophotography includes a substrate, an electro-conductive elastic layer on the substrate, and a plurality of electrically insulating domains formed in a partial region on the electro-conductive elastic layer. The electro-conductive elastic layer has a Martens hardness of 0.10 N/mm$^2$ or more and 3.00 N/mm$^2$ or less. In the surface of the member for electrophotography, the exposure ratio of the electro-conductive elastic layer per the area of a square 300 μm on a side is 50% to 90%, and the average of the areas of the portions of the respective plurality of electrically insulating domains to be brought into contact with the electro-conductive elastic layer is 300 μm$^2$ or more and 10,000 μm$^2$ or less.

7 Claims, 3 Drawing Sheets

(56) References Cited

U.S. PATENT DOCUMENTS

| | | | |
|---|---|---|---|
| 8,846,287 | B2 | 9/2014 | Yamada et al. |
| 9,017,239 | B2 | 4/2015 | Ishida et al. |
| 2006/0067747 | A1 | 3/2006 | Matsuda et al. |
| 2006/0226572 | A1 | 10/2006 | Tanaka et al. |
| 2009/0010684 | A1* | 1/2009 | Satoh ..... G03G 15/0818 399/286 |
| 2012/0082488 | A1 | 4/2012 | Kubo et al. |
| 2013/0130022 | A1 | 5/2013 | Uesugi et al. |
| 2014/0093278 | A1 | 4/2014 | Yamada et al. |

* cited by examiner

MEMBER FOR ELECTROPHOTOGRAPHY, PROCESS CARTRIDGE, AND ELECTROPHOTOGRAPHIC IMAGE FORMING APPARATUS

BACKGROUND OF THE INVENTION

1. Field of the Invention

The present invention relates to a member for electrophotography, a process cartridge, and an electrophotographic image forming apparatus.

2. Description of the Related Art

A developing method involving using a nonmagnetic one-component toner has been known as the image forming method of an electrophotographic image forming apparatus, such as a copying machine or an optical printer. Specifically, a photosensitive member serving as a rotatable electrostatic latent image-bearing member is charged by a charging unit, such as a charging roller, and an electrostatic latent image is formed by exposing the surface of the charged photosensitive member to laser light. Next, in the developing apparatus of the image forming apparatus, a toner in a developer container is applied onto a developing roller by a developer-regulating member, and the electrostatic latent image is developed with the toner at a contact portion between the photosensitive member and the developing roller. After that, the toner image on the photosensitive member is transferred onto a recording material through or without through an intermediate transfer member in a transferring portion, the toner image is fixed onto the recording material by heat and pressure in a fixing portion, and the recording material having the fixed image is discharged to the outside of the image forming apparatus.

In such image forming method, the developing apparatus includes such members for electrophotography as described below:

(1) a developer-supplying roller present in the developer container and configured to supply the toner to the developing roller;

(2) the developer-regulating member configured to form a toner layer on the developing roller and to keep the amount of the toner on the developing roller constant; and (3) the developing roller configured to develop the toner on the photosensitive member, the roller being arranged so that the roller closes the opening of the developer container storing the toner, part of the roller is exposed to the outside of the container, and the exposed portion faces the photosensitive member.

In the developing apparatus, image formation is performed by the rotation and rubbing of those members for electrophotography.

A reduction in size of the apparatus and the energy savings thereof have been advancing in recent years. One method for the reduction in size of the apparatus is a reduction in diameter of any such member for electrophotography. In addition, one method for the energy savings is a reduction in torque (a reduction in penetration amount of any such member or a reduction in peripheral speed difference between the members) at the time of the rotation and rubbing of the members for electrophotography. However, when the reduction in torque at the time of the rotation is performed by reductions in diameters of the developing roller and the developer-supplying roller, or the reduction in penetration amount of any such member or the reduction in peripheral speed difference between the members, the amount of the toner layer to be formed on the developing roller becomes insufficient and hence a uniform image is not obtained in some cases.

In Japanese Patent Application Laid-Open No. H08-286497, there is a disclosure of the following developing roller. In order to improve the toner-conveying force of a developing member, a dielectric portion having a high electric resistance value is arranged on the surface of the roller, and the charged dielectric portion is caused to electrically adsorb a toner, thereby enabling the conveyance of the toner.

The present invention is directed to providing a member for electrophotography that can achieve both an improvement in toner-conveying force under high temperature and high humidity, and excellent charge-providing performance for a toner, at high levels. In addition, the present invention is directed to providing a process cartridge and an electrophotographic image forming apparatus that can stably provide high-quality electrophotographic images under various environments.

SUMMARY OF THE INVENTION

According to one aspect of the present invention, there is provided a member for electrophotography, including: a substrate; an electro-conductive elastic layer on the substrate; and a plurality of electrically insulating domains on the electro-conductive elastic layer, in which: the electro-conductive elastic layer has a Martens hardness of 0.10 $N/mm^2$ or more and 3.00 $N/mm^2$ or less; a surface of the member for electrophotography includes at least surfaces of the electrically insulating domains and an exposed portion of the electro-conductive elastic layer not covered with the electrically insulating domains; a ratio of an area of the exposed portion of the electro-conductive elastic layer to an area of a square 300 μm on a side in the surface of the member for electrophotography is 50% or more and 90% or less; and an average of areas of portions of the respective plurality of electrically insulating domains to be brought into contact with the electro-conductive elastic layer is 300 $\mu m^2$ or more and 10,000 $\mu m^2$ or less.

According to another aspect of the present invention, there is provided an electrophotographic process cartridge, including a developing roller, the process cartridge being detachably mountable to a main body of an electrophotographic image forming apparatus, in which the developing roller is the member for electrophotography. According to still another aspect of the present invention, there is provided an electrophotographic image forming apparatus, including a developing roller, in which the developing roller is the member for electrophotography.

Further features of the present invention will become apparent from the following description of exemplary embodiments with reference to the attached drawings.

DESCRIPTION OF THE EMBODIMENTS

Figure 1:
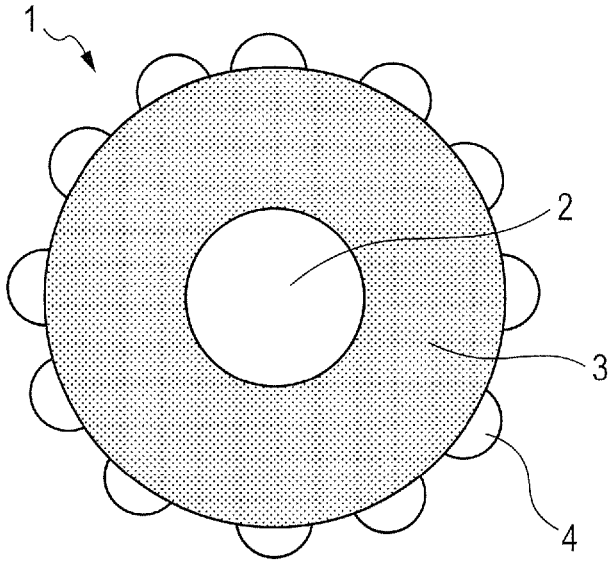
FIG. 1 is a schematic sectional view for illustrating an example of a member for electrophotography of the present invention.

Preferred embodiments of the present invention will now be described in detail in accordance with the accompanying drawings.

An investigation made by the inventors of the present invention has found that the developing roller according to Japanese Patent Application Laid-Open No. H08-286497 has an excellent toner-conveying force by virtue of the presence of the dielectric portion on its surface, but the charge-providing performance of the developing roller for a toner reduces. When such developing roller is used in the formation of an electrophotographic image, "fogging" is liable to occur in the electrophotographic image. The tendency has been particularly remarkable when the formation of the electrophotographic image is performed under a high-temperature and high-humidity environment.

A member for electrophotography according to the present invention includes a substrate, an electro-conductive elastic layer on the substrate, and a plurality of electrically insulating domains formed on the electro-conductive elastic layer.

The electro-conductive elastic layer has a Martens hardness of 0.10 $N/mm^2$ or more and 3.00 $N/mm^2$ or less. In addition, the surface of the member for electrophotography includes at least the surfaces of the electrically insulating domains and the exposed portion of the electro-conductive elastic layer not covered with the electrically insulating domains, the ratio of the area of the exposed portion of the electro-conductive elastic layer to the area of a square 300 μm on a side in the surface of the member for electrophotography is 50% or more and 90% or less, and the average of the areas of the portions of the respective plurality of electrically insulating domains to be brought into contact with the electro-conductive elastic layer is 300 $\mu m^2$ or more and 10,000 $\mu m^2$ or less.

In a member for electrophotography having electrically insulating domains called dielectric portions in a surface thereof, when the electrically insulating domains are charged, an electric field is generated between each of the domains and an electro-conductive portion, and a toner is adsorbed and conveyed by a coulomb force or a gradient force. The conveying force enlarges as the sizes and number of the electrically insulating domains increase. Meanwhile, it has been known that the provision of charge to the toner is generally performed by friction between the member for electrophotography and the toner, but an investigation made by the inventors of the present invention has found that the electrically insulating domains have little involvement in the provision of the charge to the toner. In addition, it has been found that because of the foregoing, in the related-art member for electrophotography having the electrically insulating domains, when the sizes and number of the electrically insulating domains are increased for obtaining a large conveying force, the charge-providing performance of the member for the toner reduces instead.

The present invention is described in detail below.

<Member for Electrophotography>

Figure 2:
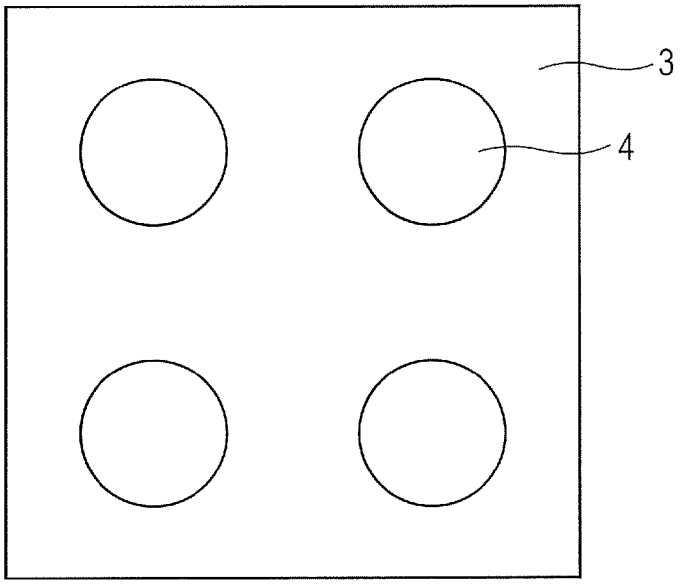
FIG. 2 is a schematic front view for illustrating an example of the member for electrophotography of the present invention.

As illustrated in FIG. 1, the member for electrophotography of the present invention includes a columnar or hollow cylindrical substrate 2 and an electro-conductive elastic layer 3. As illustrated in FIG. 1, a plurality of electrically insulating domains 4 are present on the surface of the electro-conductive elastic layer 3. That is, as illustrated in FIG. 2, the surface of the member for electrophotography of the present invention includes the surfaces of the plurality of electrically insulating domains 4 and the surface of the electro-conductive elastic layer 3 not covered with the electrically insulating domains.

[Substrate]

The substrate has electro-conductivity and has a function of supporting the electro-conductive elastic layer to be formed thereon. Examples of a material for the substrate can include: metals, such as iron, copper, aluminum, and nickel; and alloys containing these metals, such as stainless steel, duralumin, brass, and bronze. The surface of the substrate can be subjected to a plating treatment for the purpose of imparting scratch resistance to the extent that the electro-conductivity is not impaired. Further, a substrate obtained by covering the surface of a substrate made of a resin with a metal to make the surface electro-conductive or a substrate produced from an electro-conductive resin composition can be used as the substrate.

[Electro-Conductive Elastic Layer]

The electro-conductive elastic layer has a single-layer structure or a laminated structure including two or more layers. Particularly in a nonmagnetic one-component contact development process, a member for electrophotography having two electro-conductive elastic layers is suitably used as a developing roller.

The electro-conductive elastic layer contains an elastic material, such as a resin or a rubber. Specific examples of the resin and the rubber include: a polyurethane resin, polyamide, a urea resin, polyimide, a melamine resin, a fluororesin, a phenol resin, an alkyd resin, a silicone resin, polyester, ethylene-propylene-diene copolymerized rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, a hydrogenated product of NBR, and urethane rubber. Of those, silicone rubber is preferred. Examples of the silicone rubber can include polydimethylsiloxane, polymethyltrifluoropropylsiloxane, polymethylvinylsiloxane, polyphenylvinylsiloxane, and copolymers of these siloxanes. One kind of those resins and rubbers can be used alone, or two or more kinds thereof can be used in combination, as required. Of those, a polyurethane resin is preferred because of the following reasons: the resin is excellent in triboelectric charging performance for a toner; the resin is excellent in flexibility and hence an opportunity for contact with the toner can be easily obtained; and the resin has abrasion resistance. It should be noted that materials for the resin and the rubber can be identified by measuring the electro-conductive elastic layer with a Fourier transform infrared-visible spectrophotometer.

Examples of the polyurethane resin include an ether-based polyurethane resin, an ester-based polyurethane resin, an acrylic polyurethane resin, and a carbonate-based polyurethane resin. Of those, a polyether polyurethane resin, which easily provides negative charge to the toner through friction with the toner and which easily attains flexibility, is preferred.

The polyether polyurethane resin can be obtained by a reaction of known polyether polyol and a known isocyanate compound. Examples of the polyether polyol include polyethylene glycol, polypropylene glycol, and polytetramethylene glycol. In addition, those polyol components may each be used as a prepolymer thereof subjected to chain elongation in advance with an isocyanate, such as 2,4-tolylene diisocyanate, 2,6-tolylene diisocyanate (TDI), diphenylmethane diisocyanate (MDI), or isophorone diisocyanate (IPDI), as required.

The isocyanate compound to be caused to react with the polyol components is not particularly limited and examples thereof include: aliphatic polyisocyanates, such as ethylene diisocyanate and 1,6-hexamethylene diisocyanate (HDI); alicyclic polyisocyanates, such as isophorone diisocyanate (IPDI), cyclohexane 1,3-diisocyanate, and cyclohexane 1,4-diisocyanate; aromatic polyisocyanates, such as 2,4-tolylene diisocyanate, 2,6-tolylene diisocyanate (TDI), and diphenylmethane diisocyanate (MDI); and modified or copolymerized products thereof and blocked products thereof.

The electro-conductive elastic layer preferably contains an electro-conductive agent for obtaining electro-conductivity. Examples of the electro-conductive agent include an ionic electro-conductive agent and an electronic electro-conductive agent, such as carbon black. Of those, carbon black is preferred because the carbon black can control the electro-conductivity of the electro-conductive elastic layer and the charging performance of the electro-conductive elastic layer for a toner. In ordinary cases, the volume resistivity of the electro-conductive elastic layer preferably falls within the range of from $10^3$ Ω·cm or more to $10^{11}$ Ω·cm or less.

Specific examples of the carbon black may include: electro-conductive carbon black, such as "KETJEN-BLACK" (trade name, manufactured by Lion Specialty Chemicals Co., Ltd.) or acetylene black; and carbon black for rubber, such as SAF, ISAF, HAF, FEF, GPF, SRF, FT, or MT. In addition, oxidatively-treated carbon black for a color ink or pyrolytic carbon black can be used. The addition amount of the carbon black is preferably 5 parts by mass or more and 50 parts by mass or less with respect to 100 parts by mass of the resin or the rubber. The content of the carbon black in the electro-conductive elastic layer can be measured with a thermogravimetric analysis apparatus (TGA).

In addition to the above-mentioned carbon blacks, examples of the electro-conductive agent that can be used can include: graphite, such as natural graphite or artificial graphite; powder of a metal, such as copper, nickel, iron, or aluminum; powder of a metal oxide, such as titanium oxide, zinc oxide, or tin oxide; and a conductive polymer, such as polyaniline, polypyrrole, or polyacetylene. One kind of those electro-conductive agents can be used alone, or two or more kinds thereof can be used in combination, as required.

In addition to the foregoing, a charge control agent, a lubricant, a filler, an antioxidant, or an age inhibitor can be incorporated into the electro-conductive elastic layer to the extent that the functions of the resin or the rubber and the electro-conductive agent are not inhibited.

The thickness of the electro-conductive elastic layer is preferably 1 μm or more and 5 mm or less. This is because conveying performance for a toner can be additionally stabilized. The thickness of the electro-conductive elastic layer can be determined by observing and measuring a section thereof with an optical microscope.

When a surface roughness is required upon use of the member for electrophotography as a developing roller, fine particles for roughness control can be incorporated into the electro-conductive elastic layer. The volume-average particle diameter of the fine particles for roughness control is preferably 3 μm or more and 20 μm or less. In addition, the amount of the fine particles to be incorporated into the electro-conductive elastic layer is preferably 1 part by mass or more and 50 parts by mass or less with respect to 100 parts by mass of the resin or the rubber.

Specifically, for example, resin particles each containing a resin, such as a polyurethane resin, a polyester resin, a polyether resin, a polyamide resin, an acrylic resin, or a polycarbonate resin, can be used as the fine particles for roughness control.

[Martens Hardness]

The Martens hardness of the electro-conductive elastic layer is 0.10 N/mm$^2$ or more and 3.00 N/mm$^2$ or less, preferably 0.10 N/mm$^2$ or more and 1.00 N/mm$^2$ or less. Setting the Martens hardness within the numerical range imparts moderate softness to the electro-conductive elastic layer. As a result, upon use of the member for electrophotography as a developing roller, the number of opportunities for contact between the developing roller and a toner increases, and hence the provision of charge to the toner can be sufficiently performed. In addition, rubbing between each of the electrically insulating domains and the toner can be effectively performed, and hence the charge quantities of the electrically insulating domains increase and a sufficient toner-conveying force can be obtained. When the Martens hardness is less than 0.10 N/mm$^2$, the electro-conductive elastic layer is so soft that the thickness of a toner layer increases and hence the provision of the charge to the toner cannot be sufficiently performed. In addition, when the Martens hardness is more than 3.00 N/mm$^2$, the electro-conductive elastic layer is hard, and the number of opportunities for the contact between the developing roller and the toner reduces, and hence the provision of the charge to the toner becomes insufficient.

[Method of Measuring Martens Hardness]

The measurement of the Martens hardness of the electro-conductive elastic layer is performed as described below by using the member for electrophotography. Used as a measuring apparatus is PICODENTOR HM500 manufactured by Fischer. A Vickers indenter is used as a measurement indenter. The member for electrophotography is arranged to be horizontal to the indenter, and the surface of the electro-conductive elastic layer not covered with the electrically insulating domains in the surface of the member for electrophotography is observed with a microscope. The observation is performed under the conditions of an indenter penetration speed of 1 μm/sec, a maximum indentation load of 0.1 mN, and an indentation time of 20 seconds. The Martens hardness is represented by the equation "maximum indentation load/(26.43×(indentation depth)$^2$)," and is calculated by detecting the "indentation depth."

[Electrically Insulating Domains]

The plurality of electrically insulating domains are present in a partial region on the surface of the member for electrophotography. That is, the surface of the member for electrophotography includes the plurality of electrically insulating domains and the exposed portion of the electro-conductive elastic layer not covered with the electrically insulating domains. The volume resistivity of each of the electrically insulating domains is preferably $1\times10^{13}$ Ω·cm or more and $1\times10^{18}$ Ω·cm or less, particularly preferably $1\times10^{14}$ Ω·cm or more and $1\times10^{17}$ Ω·cm or less. This is because the electrically insulating domains can be easily charged.

Examples of a material constituting the electrically insulating domains include a resin and a metal oxide. Of those, a resin is preferred. Specific examples of the resin include an acrylic resin, a polyolefin resin, an epoxy resin, and a polyester resin. Of those, an acrylic resin is preferred because the volume resistivity of each of the electrically insulating domains can be easily adjusted to fall within the range. Specific examples of the acrylic resin include: a polymer and copolymer of methyl methacrylate, 4-tert-butylcyclohexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, isobornyl acrylate, and ethoxylated bisphenol A diacrylate.

Examples of a method of forming the electrically insulating domains on the electro-conductive elastic layer include various printing methods. Of those, a jet dispenser method and an inkjet method are preferred in order that the plurality of electrically insulating domains may be caused to exist in a partial region on the surface of the electro-conductive elastic layer.

[Exposure Ratio of Electro-Conductive Elastic Layer]

In the surface of the member for electrophotography of the present invention, the ratio of the area of the exposed portion of the electro-conductive elastic layer to the area of a square 300 μm on a side defined as 100% (hereinafter sometimes referred to as "exposure ratio $R_E$") is 50% or more and 90% or less. The exposure ratio $R_E$ is preferably 60% or more and 80% or less. Setting the exposure ratio $R_E$ within the range can adjust the toner-conveying force of the member for electrophotography (developing roller) to a proper amount, and enables sufficient rubbing between the electro-conductive elastic layer and a toner. As a result, the developing roller can sufficiently provide the toner with triboelectric charge. In addition, a sufficient toner-conveying force can be obtained even under high temperature and high humidity.

[Areas of Electrically Insulating Domains]

The average of the areas of the portions of the respective plurality of electrically insulating domains to be brought into contact with the electro-conductive elastic layer (hereinafter sometimes referred to as "average base area $S_D$") is 300 $\mu m^2$ or more and 10,000 $\mu m^2$ or less. The average base area $S_D$ is preferably 1,000 $\mu m^2$ or more and 5,100 $\mu m^2$ or less. Setting the average base area $S_D$ within the range can adjust the toner-conveying force of the member for electrophotography (developing roller) to a proper amount, and enables sufficient rubbing between the member for electrophotography and a toner. In addition, as a result of the foregoing, the conveying force of the developing roller for the toner improves and its triboelectric charge-providing performance for the toner also improves.

[Heights of Electrically Insulating Domains]

An average $H_D$ of the heights of the respective plurality of electrically insulating domains from the portions to be brought into contact with the electro-conductive elastic layer is preferably 1.0 μm or more and 15.0 μm or less. When the average $H_D$ of the heights is set to 1.0 μm or more, the toner-conveying force can be easily obtained. When the average is set to 15.0 μm or less, rubbing between the electro-conductive elastic layer and a toner easily occurs, and hence the provision of charge to the toner can be easily performed.

[Methods of Measuring Exposure Ratio and Average Base Area]

In the present invention, the average base area $S_D$ and the exposure ratio $R_E$ are measured as described below. An objective lens having a magnification of 20 is installed in a laser microscope VK-8700 manufactured by Keyence Corporation, and the surface of the member for electrophotography is observed. Next, the resultant observation image is subjected to inclination correction. The inclination correction is performed in a quadratic surface correction mode. The exposure ratio of the electro-conductive elastic layer in a square area 300 μm on a side at the center of the corrected image is measured. The measurement is performed by using an image processing software, such as ImageJ. The measurement of the exposure ratio is performed for 10 points of the member for electrophotography (1 site of each of 10 regions obtained by dividing the member into 10 equal sections in its longitudinal direction), and the arithmetic average of the measured values is defined as the exposure ratio $R_E$ of the present invention.

In addition, an image subjected to the inclination correction is similarly used in the measurement of the average base area, and the electrically insulating domains falling within the image are subjected to the measurement. As in the exposure ratio, 10 points of the member for electrophotography are observed, and the arithmetic average of the resultant values is defined as the average base area $S_D$ of the present invention. At that time, all the electrically insulating domains completely included in a square area 300 μm on a side are defined as measuring objects, and the electrically insulating domain that is not completely included therein is not defined as a measuring object.

[Measurement of Heights of Electrically Insulating Domains]

In addition, an image subjected to the inclination correction is similarly used in the measurement of the heights of the electrically insulating domains, and the electrically insulating domains falling within the image are subjected to the measurement. A difference "$H_2-H_1$" between a highest point $H_2$ of the electrically insulating domains and a height $H_1$ of the electro-conductive elastic layer is calculated by using the resultant three-dimensional observation image. 10 Points of the member for electrophotography (1 site of each of 10 regions obtained by dividing the member into 10 equal sections in its longitudinal direction) are observed, and the arithmetic average of the resultant "$H_2-H_1$" values is defined as the average $H_D$ of the heights of the electrically insulating domains of the present invention. At that time, all the electrically insulating domains completely included in a square area 300 μm on a side are defined as measuring objects, and the electrically insulating domain that is not completely included therein is not defined as a measuring object.

When the jet dispenser method or the inkjet method is used, the heights and base areas of the electrically insulating domains can be regulated by conditions, such as the kind of their material and an ejection amount.

The Martens hardness of each of the electrically insulating domains of the present invention is preferably from 100 $N/mm^2$ to 800 $N/mm^2$. Setting the hardness within the range can provide a sufficient toner conveyance amount.

<Electrophotographic Image Forming Apparatus>

Figure 3:
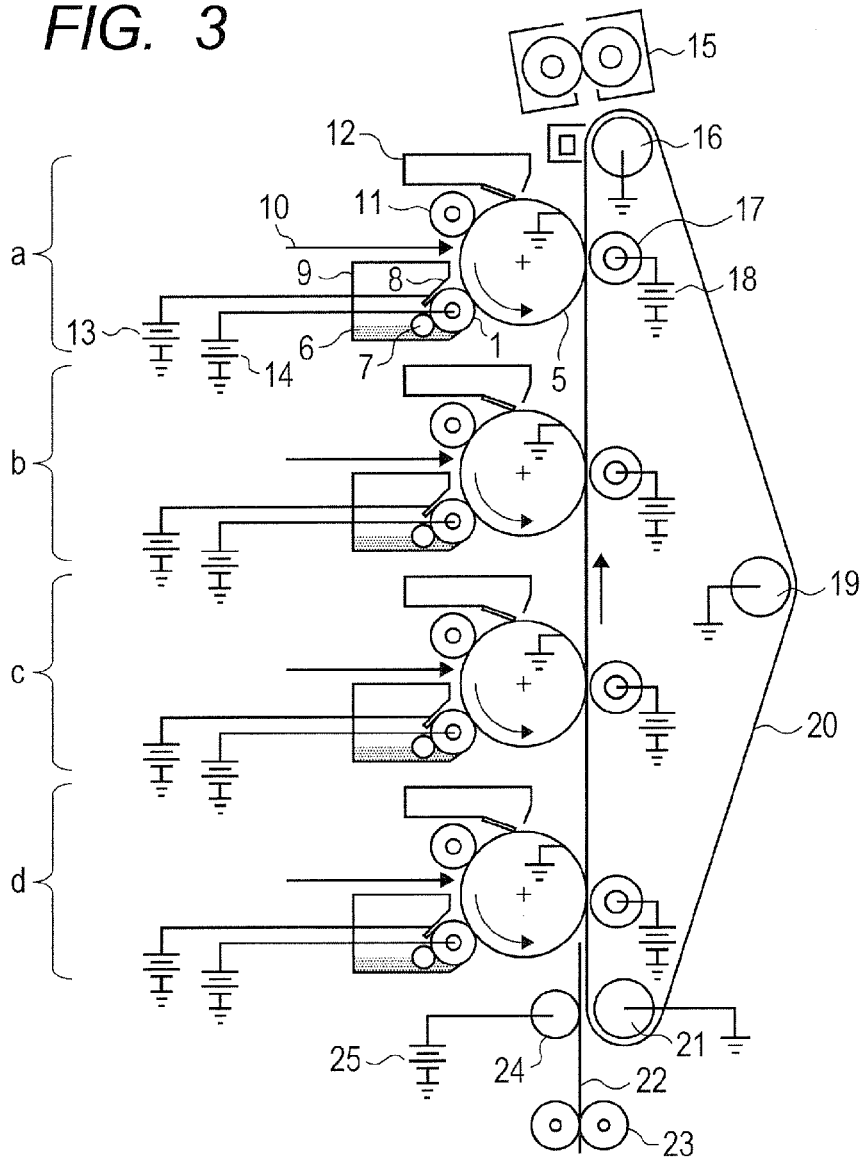
FIG. 3 is a schematic construction view for illustrating an example of an electrophotographic image forming apparatus according to the present invention.

An electrophotographic image forming apparatus of the present invention includes the member for electrophotography of the present invention as a developing roller. FIG. 3 is an illustration of an example of the electrophotographic image forming apparatus of the present invention. In FIG. 3, image forming units a to d are arranged for respective color toners, i.e., a yellow toner, a magenta toner, a cyan toner, and a black toner. A photosensitive member 5 serving as an electrostatic latent image-bearing member rotating in a direction indicated by the arrow is arranged in each of the image forming units a to d. Arranged around each of the photosensitive members 5 are a charging apparatus 11 for uniformly charging the photosensitive member 5, an exposing unit (not shown) configured to irradiate the photosensitive member 5 uniformly subjected to the charging treatment with laser light 10 to form an electrostatic latent image, and a developing apparatus 9 configured to supply a toner to the photosensitive member 5 having formed thereon the electrostatic latent image to develop the electrostatic latent image.

Meanwhile, a transfer conveyance belt 20 configured to convey a recording material 22, such as paper, fed from a sheet-feeding roller 23 is arranged by being suspended over a driver roller 16, a driven roller 21, and a tension roller 19. The charge of an adsorption bias power source 25 is adapted to be applied to the transfer conveyance belt 20 through an adsorption roller 24 to electrostatically adhere the recording material 22 to the surface of the belt, thereby conveying the recording material.

A transfer bias power source 18 configured to apply charge for transferring the toner images on the photosensitive members 5 of the respective image forming units a to d onto the recording material 22 conveyed by the transfer conveyance belt 20 is arranged. A transfer bias is applied through a transfer roller 17 arranged on the back surface of the transfer conveyance belt 20. The toner images of respective colors formed in the respective image forming units a to d are adapted to be sequentially superimposed and transferred onto the recording material 22 conveyed by the transfer conveyance belt 20 operated in synchronization with the respective image forming units a to d.

Further arranged in the color electrophotographic image forming apparatus are a fixing apparatus 15 configured to fix the toner images superimposed and transferred onto the recording material 22 through heating or the like, and a conveying apparatus (not shown) configured to discharge the recording material 22 having formed thereon the images to the outside of the apparatus.

Meanwhile, a cleaning apparatus 12 having a cleaning blade configured to remove a transfer residual toner remaining on each of the photosensitive members 5 without being transferred to clean its surface is arranged in each of the image forming units. The cleaned photosensitive member 5 is adapted to be brought into an image formable state and to wait.

Arranged in the developing apparatus 9 arranged in each of the image forming units are a developer container 6 storing a nonmagnetic developer (toner) as a one-component developer, and a developing roller 1 installed so that the roller closes the opening of the developer container 6 and a portion thereof exposed from the developer container faces the photosensitive member.

Arranged in the developer container 6 are a developer-supplying roller 7 for supplying a toner to the developing roller 1, and at the same time, for scraping off the toner remaining on the developing roller 1 without being used after development, and a developer-regulating member 8 configured to form the toner on the developing roller 1 into a thin film shape, and to triboelectrically charge the toner. Those components are arranged to abut with the developing roller 1, and the developing roller 1 and the developer-supplying roller 7 each rotate in a forward direction. It should be noted that a blade bias power source is represented by reference numeral 13 and a developing roller bias power source is represented by reference numeral 14.

<Electrophotographic Process Cartridge>

Figure 4:
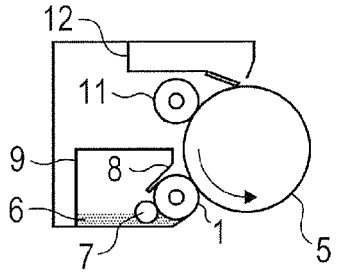
FIG. 4 is a schematic construction view for illustrating an example of an electrophotographic process cartridge of the present invention.

An electrophotographic process cartridge of the present invention includes the member for electrophotography of the present invention as a developing roller, and is detachably mountable to the main body of an electrophotographic image forming apparatus. FIG. 4 is an illustration of an example of the electrophotographic process cartridge of the present invention. The electrophotographic process cartridge illustrated in FIG. 4 includes the developing apparatus 9, the photosensitive member 5, and the cleaning apparatus 12, and these components are integrated and are detachably mountable to the main body of the electrophotographic image forming apparatus. Examples of the developing apparatus 9 can include the same apparatus as those of the image forming units described in the section "Electrophotographic Image Forming Apparatus." The electrophotographic process cartridge of the present invention may be such that in addition to the members, for example, a transfer member configured to transfer a toner image on the photosensitive member 5 onto the recording material 22 is integrally arranged together with the members.

In the present invention, a toner charge quantity is preferably 25 μC/g or more, more preferably 35 μC/g or more. In addition, a toner conveyance amount on the developing roller is preferably 0.30 $mg/cm^2$ or more, more preferably 0.35 $mg/cm^2$ or more.

According to one embodiment of the present invention, there can be provided a member for electrophotography that can achieve both an improvement in toner-conveying force under high temperature and high humidity, and excellent charge-providing performance for a toner, at high levels.

In addition, according to another embodiment of the present invention, there can be provided a process cartridge and an electrophotographic image forming apparatus each of which can provide a high-quality image under various environments through the suppression of fogging while obtaining the uniformity of an image density.

The present invention is specifically described below by way of Production Examples and Examples.

[Production Example 1] Production of Electro-Conductive Elastic Roller 1

Prepared as a substrate was a substrate obtained by applying and baking a primer (trade name: DY 35-051; manufactured by Dow Corning Toray Co., Ltd.) onto a mandrel made of SUS304 having an outer diameter of 6 mm and a length of 270 mm. The substrate was placed in a mold, and an addition-type silicone rubber composition obtained by mixing materials shown in Table 1 below was injected into a cavity formed in the mold. Subsequently, the mold was heated to heat and cure the silicone rubber at a temperature of 150° C. for 15 minutes, and the resultant was removed from the mold. After that, a curing reaction was completed by further heating the resultant at a temperature of 180° C. for 1 hour. Thus, an electro-conductive elastic roller 1 having an electro-conductive elastic layer having a thickness of 3 mm on the outer periphery of the substrate was produced.

TABLE 1

| Material | Part(s) by mass |
|---|---|
| Liquid silicone rubber material (trade name: SE6724A/B; manufactured by Dow Corning Toray Co., Ltd.) | 100 |
| Carbon black (trade name: TOKABLACK #7360SB; manufactured by Tokai Carbon Co., Ltd.) | 20 |
| Platinum catalyst | 0.1 |

[Production Example 2] Production of Electro-Conductive Elastic Roller 2

A substrate was prepared in the same manner as in Production Example 1. In addition, materials shown in Table 2 below were kneaded to prepare an unvulcanized rubber composition. Next, a crosshead extruder having a mechanism configured to supply the substrate and a mechanism configured to discharge the unvulcanized rubber composition was prepared, a die having an inner diameter of 12.1 mm was mounted on a crosshead, the temperatures of the extruder and the crosshead were adjusted to 30° C., and the speed at which the substrate was conveyed was adjusted to 60 mm/sec. Under the conditions, the unvulcanized rubber composition was supplied from the extruder, and the outer periphery of the substrate was covered with the unvulcanized rubber composition serving as an elastic layer in the crosshead. Thus, an unvulcanized rubber roller 2 was obtained. Next, the unvulcanized rubber roller was loaded into a hot-air vulcanizing furnace at 170° C., and was heated for 15 minutes to vulcanize the rubber. Thus, an electro-conductive elastic roller 2 having an electro-conductive elastic layer having a thickness of 3 mm on the outer periphery of the substrate was produced.

TABLE 2

| Material | Part(s) by mass |
|---|---|
| Millable silicone rubber material (trade name: TSE270-4U; manufactured by Momentive Performance Materials Japan LLC) | 100 |
| Carbon black (trade name: TOKABLACK #7360SB; manufactured by Tokai Carbon Co., Ltd.) | 15 |
| Curing agent (trade name: TC-8; manufactured by Momentive Performance Materials Japan LLC) | 0.5 |

[Production Example 3] Production of Electro-Conductive Elastic Roller 3

Two kinds of materials shown in the column "Component 1" of Table 3 below were added to 200 parts by mass of methyl ethyl ketone (MEK), and the contents were mixed. Next, under a nitrogen atmosphere, the mixture was subjected to a reaction at a temperature of 80° C. for 4 hours to provide a polyurethane polyol prepolymer. 100 Parts by mass of the polyurethane polyol prepolymer and other two kinds of materials shown in the column "Component 2" of Table 3 below were added at blending ratios shown in Table 3 to 400 parts by mass of MEK so that a total solid content became 30 mass %, followed by stirring and dispersion in a ball mill. Thus, a dispersion liquid was obtained. In addition, an electro-conductive elastic roller 3' was produced in the same manner as in Production Example 1 by using the addition-type silicone rubber composition and a mold.

TABLE 3

| | Material | Production Example 3 | Production Example 7 | Production Example 8 | Production Example 9 | Production Example 10 |
|---|---|---|---|---|---|---|
| Component 1 | Polytetramethylene glycol (trade name: "PolyTHF", manufactured by BASF) | 100 | 100 | 100 | 100 | 100 |
| | Isocyanate (trade name: "Millionate MT" (MDI), manufactured by Tosoh Corporation) | 18 | 18 | 18 | 18 | 18 |
| Component 2 | Polyurethane polyol prepolymer | 100 | 100 | 100 | 100 | 100 |
| | Isocyanate (trade name: "CORONATE T-80", manufactured by Tosoh Corporation) | 45 | 45 | 45 | 45 | 45 |
| | Acrylic resin (trade name: "HA3001", manufactured by Hitachi Chemical Co., Ltd.) | — | 1 | 3 | — | — |
| | Polyether-modified silicone oil (trade name: "TSF4440", manufactured by Tanac Co., Ltd.) | — | — | — | 1 | 2 |
| | Carbon black (trade name: "MA100", manufactured by Mitsubishi Chemical Corporation) | 36 | 36 | 36 | 36 | 36 |

The unit of the numerical value in the table is part(s) by mass.

Next, the electro-conductive elastic roller 3' was immersed in the dispersion liquid serving as an application liquid while the upper end portion of the substrate was held with the longitudinal direction of the roller set to a vertical direction, and the application liquid was applied by a dipping method so as to have a thickness of 10.0 μm. The time period for which the roller was immersed in the application liquid was set to 9 seconds, the initial and final speeds at which the roller was pulled up from the application liquid were set to 30 mm/s and 20 mm/s, respectively, and the speed was linearly changed with time between these speeds. The resultant applied product was dried in an oven at a temperature of 80° C. for 15 minutes, and was then subjected to a curing reaction in an oven at a temperature of 140° C. for 2 hours. Thus, an electro-conductive elastic roller 3 was produced.

[Production Example 4] Production of Electro-Conductive Elastic Roller 4

Three kinds of materials shown in Table 4 below were added to 465 parts by mass of MEK so that a total solid content became 25 mass %, followed by stirring and dispersion in a ball mill. Thus, a dispersion liquid was obtained. Next, an electro-conductive elastic roller 4 was produced in the same manner as in Production Example 3 except that the thickness of the dispersion liquid at the time of its application was set to 4.0 μm.

TABLE 4

| Material | Parts by mass |
|---|---|
| Poly(tetramethylene ether/3-methyltetra methylene ether) glycol (trade name: "PTGL3000", manufactured by Hodogaya Chemical Co., Ltd.) | 100 |
| Isocyanate (HDI, manufactured by Tosoh Corporation) | 30 |
| Carbon black (trade name: "MA100", manufactured by Mitsubishi Chemical Corporation) | 33 |

[Production Example 5] Production of Electro-Conductive Elastic Roller 5

Three kinds of materials shown in Table 5 below were added to 396 parts by mass of MEK so that a total solid content became 30 mass %, followed by stirring and dispersion in a ball mill. Thus, a dispersion liquid was obtained. Next, an electro-conductive elastic roller 5 was produced in the same manner as in Production Example 3.

TABLE 5

| Material | Parts by mass |
|---|---|
| Polyester polyol (trade name: "Kuraray Polyol P-3010", manufactured by Kuraray Co., Ltd.) | 100 |
| Isocyanate (MDI, manufactured by Tosoh Corporation) | 45 |
| Carbon black (trade name: "MA100", manufactured by Mitsubishi Chemical Corporation) | 36 |

[Production Example 6] Production of Electro-Conductive Elastic Roller 6

Two kinds of materials shown in Table 6 below were added to 680 parts by mass of MEK so that a total solid content became 15 mass %, followed by stirring and dispersion in a ball mill. Thus, a dispersion liquid was obtained. Next, the dispersion liquid was applied by a dipping method in the same manner as in Production Example 3 except that its thickness at the time of the application was set to 3.0 μm. The resultant applied product was dried in an oven at a temperature of 100° C. for 15 minutes. Thus, an electro-conductive elastic roller 6 was produced.

TABLE 6

| Material | Parts by mass |
|---|---|
| Alcohol soluble nylon (trade name: "FINE RESIN FR-101", manufactured by Namariichi Co., Ltd.) | 100 |

TABLE 6-continued

| Material | Parts by mass |
|---|---|
| Carbon black (trade name: "MA100", manufactured by Mitsubishi Chemical Corporation) | 20 |

[Production Examples 7 to 10] Production of Electro-Conductive Elastic Rollers 7 to 10

Electro-conductive elastic rollers 7 to 10 were each produced in the same manner as in Production Example 3 except that the materials to be used were changed to conditions shown in the column "Component 2" of Table 3.

[Production Example 11] Production of Electro-Conductive Elastic Roller 11

Materials shown in Table 7 below were added to 336 parts by mass of MEK so that a total solid content became 30 mass %, followed by stirring and dispersion in a ball mill. Thus, a dispersion liquid was obtained. Next, an electro-conductive elastic roller 11 was produced in the same manner as in Production Example 3.

TABLE 7

| Material | Parts by mass |
|---|---|
| Polyester polyol (trade name: "Kuraray Polyol P-1010", manufactured by Kuraray Co., Ltd.) | 100 |
| Isocyanate (MDI, manufactured by Tosoh Corporation) | 15 |
| Carbon black (trade name: "MA100", manufactured by Mitsubishi Chemical Corporation) | 29 |

[Production Example 12] Production of Electro-Conductive Elastic Roller 12

Three kinds of materials shown in Table 8 below were added to 315 parts by mass of MEK so that a total solid content became 30 mass %, followed by stirring and dispersion in a ball mill. Thus, a dispersion liquid was obtained. Next, an electro-conductive elastic roller 12 was produced in the same manner as in Production Example 3.

TABLE 8

| Material | Parts by mass |
|---|---|
| Polyester polyol (trade name: "Kuraray Polyol P-520", manufactured by Kuraray Co., Ltd. | 100 |
| Isocyanate (MDI, manufactured by Tosoh Corporation) | 8 |
| Carbon black (trade name: "MA100", manufactured by Mitsubishi Chemical Corporation) | 27 |

[Production Example 21] Production of Electrically Insulating Domain Raw Material 1

15 Parts by mass of ethoxylated bisphenol A diacrylate (trade name: "A-BPE-4", manufactured by Shin-Nakamura Chemical Co., Ltd.), 85 parts by mass of isobornyl acrylate (trade name: "SR506NS", manufactured by Tomoe Engineering Co., Ltd.), and 5 parts by mass of 1-hydroxycyclohexyl-phenyl-ketone (trade name: "IRGACURE 184", manufactured by BASF) serving as a photoinitiator were mixed to provide an electrically insulating domain raw material 1.

[Production Examples 22 to 27] Production of Electrically Insulating Domain Raw Materials 2 to 7

Electrically insulating domain raw materials 2 to 7 were each obtained by changing the kinds and usage amounts of the acrylate components to conditions shown in Table 9.

TABLE 9

| | Production Examples | | | | | | |
|---|---|---|---|---|---|---|---|
| | No. 21 | No. 22 | No. 23 | No. 24 | No. 25 | No. 26 | No. 27 |
| Electrically insulating domain raw material | No. 1 | No. 2 | No. 3 | No. 4 | No. 5 | No. 6 | No. 7 |
| Ethoxylated bisphenol A diacrylate (trade name: A-BPE-4, manufactured by Shin-Nakamura Chemical Co., Ltd.) | 15 | 30 | 50 | — | — | 5 | 80 |
| Trimethylolpropane triacrylate (trade name: A-TMPT, manufactured by Shin-Nakamura Chemical Co., Ltd.) | — | — | — | 15 | 30 | — | — |
| Isobornyl acrylate (trade name: SR506NS, manufactured by Tomoe Engineering Co., Ltd.) | 85 | 70 | 50 | 85 | 70 | 95 | — |
| 1-Hydroxy-cyclohexyl phenyl ketone (trade name: IRGACURE 184, manufactured by BASF) | 5 | 5 | 5 | 5 | 5 | 5 | 5 |
| Methyl ethyl ketone (trade name: 2-butanone, manufactured by Kishida Chemical Co., Ltd.) | — | — | — | — | — | — | 20 |

Example 1

1. Production and Physical Property Evaluations of Member for Electrophotography The droplet amount of the electrically insulating domain raw material 2 obtained in Production Example 22 was adjusted to 15 pl by using a piezoelectric inkjet head. After that, the raw material was applied onto the peripheral surface of the electro-conductive elastic roller 3 obtained in Production Example 3. The application was performed while the electro-conductive elastic roller was rotated, and was performed so that intervals between electrically insulating domains in the peripheral direction and longitudinal direction of the roller each became 75 μm. After that, the electrically insulating domain raw material was cured by being irradiated with UV light having a wavelength of 254 nm from a low-pressure mercury lamp for 10 minutes so that its integrated light quantity became 1,500 mJ/cm$^2$. Thus, a member 1 for electrophotography was produced.

Figure 5:
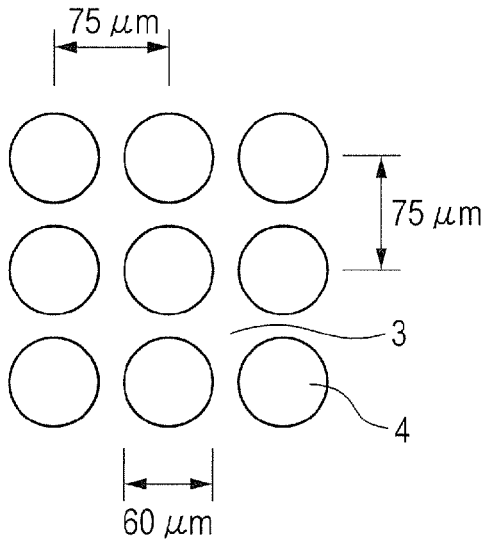
FIG. 5 is a schematic front view for illustrating an example of the member for electrophotography of the present invention.
Figure 6:
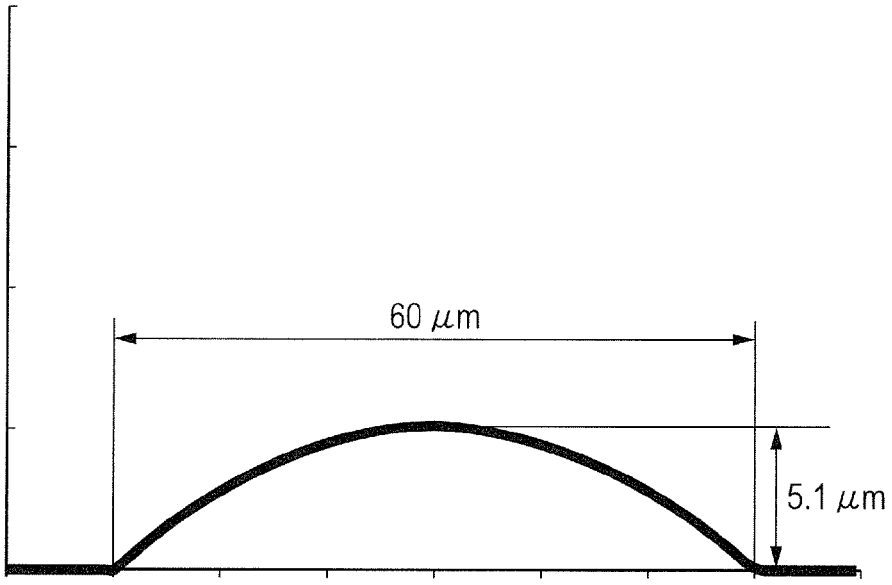
FIG. 6 is a schematic sectional view for illustrating an example of the member for electrophotography of the present invention.

The resultant member 1 for electrophotography was measured for the Martens hardness and exposure ratio $R_E$ of the electro-conductive elastic layer, and the average base area $S_D$, and the average $H_D$ of the heights, of the electrically insulating domains in accordance with the methods of the present invention. FIG. 5 is an illustration of an example of a front observation view of the electrically insulating domains. As illustrated in FIG. 5, each of the electrically insulating domains had a substantially circular shape and had a diameter of 60 μm, and the interval between the electrically insulating domains was 75 μm. In addition, an example of the measurement of the height of each of the electrically insulating domains is illustrated in FIG. 6. As illustrated in FIG. 6, the height of the electrically insulating domain was 5.1 μm. In addition, the results of the measurement are shown in Table 11.

2. Evaluations by Electrophotographic Image Forming Apparatus

Next, the member 1 for electrophotography was incorporated as a developing roller into an electrophotographic image forming apparatus, and a performance evaluation and an image output evaluation were performed. A laser beam printer having a construction illustrated in FIG. 3 (trade name: CLJ CP4525, manufactured by Hewlett-Packard Company) was used as the electrophotographic image forming apparatus. The member 1 for electrophotography was loaded as the developing roller into the magenta cartridge of the electrophotographic image forming apparatus, and was then left to stand under a high-temperature and high-humidity environment having a temperature of 35° C. and a relative humidity of 85% for 24 hours. The results of the evaluations are shown in Table 12. It should be noted that the gear of the cartridge was reconstructed for the purpose of a reduction in torque so that a developer-supplying roller rotated in a forward direction with respect to the developing roller.

[2-1. Evaluations for Toner Charge Quantity and Fogging]

A white solid image was output on 5 sheets at a speed of 10 sheets/min, and then the operation of the printer was stopped in the course of the output of the white solid image on 1 sheet. A toner was sucked from a toner layer formed on the developing roller with a suction nozzle having an opening having a diameter of 5 mm, and a toner charge quantity (μC/g) was determined by measuring the charge quantity of the sucked toner and the mass of the toner. The charge quantity was measured with a digital electrometer (trade name: 8252, manufactured by ADC Corporation).

In addition, the toner adhering onto a photosensitive member was peeled off with a transparent tape (trade name: Polyester Tape No. 550, manufactured by Nichiban Co., Ltd.), and was attached to white paper (Business Multipurpose 4200; manufactured by Xerox Corporation). Thus, a sample for an evaluation was obtained. Next, a reflection density $R_1$ of the sample for an evaluation was measured with a reflection densitometer (TC-6DS/A; manufactured by Tokyo Denshoku Co., Ltd.). At that time, a green filter was used as a filter. Meanwhile, a reflection density $R_0$ of a reference sample obtained by attaching only the transparent tape to the white paper was similarly measured. An amount "$R_0$-$R_1$" (%) by which the reflectance of the sample for an evaluation reduced as compared to that of the reference sample was defined as a fogging value (%). The criteria of an evaluation for fogging are as described below.

| | |
|---|---|
| Less than 2.5%: | Satisfactory |
| 2.5% or more and less than 5%: | Within an allowable range |
| 5% or more: | Poor |

[2-2. Evaluations for Toner Conveyance Amount and Image Density Difference]

A black solid image was output on 1 sheet at a speed of 40 sheets/min, and then the operation of the printer was stopped in the trailing end portion of an additional solid black image during the output of the image. A toner was sucked from a toner layer formed on the developing roller with a suction nozzle having an opening having a diameter of 5 mm, and a toner conveyance amount (mg/cm$^2$) was determined by measuring the mass of the sucked toner and the area of a region subjected to the suction.

Next, a black solid image was output on 1 sheet at a speed of 40 sheets/min, the image density of the resultant black solid image was measured with a spectral densitometer (trade name: 508, manufactured by X-Rite Inc.), and a density difference between the leading end and trailing end of the image was determined. The criteria of an evaluation for the image density difference are as described below.

| | |
|---|---|
| Less than 0.05: | Satisfactory |
| 0.05 or more and less than 0.20: | Within an allowable range |
| 0.20 or more: | Poor |

Examples 2 to 18 and Comparative Examples 1 to 8

Members 2 to 18 for electrophotography (Examples 2 to 18) and members C1 to C8 for electrophotography (Comparative Examples 1 to 8) were each obtained by the same method as that of Example 1 except that the kinds of the electro-conductive elastic roller and the electrically insulating domain raw material were changed to conditions shown in Table 10, and the members were subjected to physical property measurement and image evaluations. The results of the measurement and the results of the evaluations are shown in Table 11 and Table 12.

TABLE 10

| | Electro-conductive elastic roller No. | Electrically insulating domain raw material No. | Interval between electrically insulating domains (μm) |
|---|---|---|---|
| Member 1 for electrophotography | 3 | 2 | 75 |
| Member 2 for electrophotography | 3 | 2 | 90 |

TABLE 10-continued

| | Electro-conductive elastic roller No. | Electrically insulating domain raw material No. | Interval between electrically insulating domains (μm) |
|---|---|---|---|
| Member 3 for electrophotography | 3 | 2 | 105 |
| Member 4 for electrophotography | 3 | 2 | 120 |
| Member 5 for electrophotography | 3 | 2 | 170 |
| Member 6 for electrophotography | 3 | 1 | 30 |
| Member 7 for electrophotography | 3 | 4 | 60 |
| Member 8 for electrophotography | 3 | 5 | 120 |
| Member 9 for electrophotography | 3 | 3 | 180 |
| Member 10 for electrophotography | 4 | 2 | 105 |
| Member 11 for electrophotography | 5 | 2 | 105 |
| Member 12 for electrophotography | 8 | 2 | 100 |
| Member 13 for electrophotography | 7 | 2 | 100 |
| Member 14 for electrophotography | 9 | 2 | 100 |
| Member 15 for electrophotography | 10 | 2 | 90 |
| Member 16 for electrophotography | 2 | 2 | 100 |
| Member 17 for electrophotography | 6 | 2 | 100 |
| Member 18 for electrophotography | 11 | 2 | 105 |
| Member C1 for electrophotography | 12 | 2 | 105 |
| Member C2 for electrophotography | 1 | 2 | 93 |
| Member C3 for electrophotography | 3 | 2 | 93 |
| Member C4 for electrophotography | 3 | 2 | 93 |
| Member C5 for electrophotography | 3 | 6 | 30 |
| Member C6 for electrophotography | 3 | 7 | 300 |
| Member C7 for electrophotography | 12 | 2 | 75 |
| Member C8 for electrophotography | 12 | 2 | 180 |

TABLE 11

| | Martens hardness N/mm$^2$ | Exposure ratio $R_E$ % | Average base area $S_D$ μm$^2$ | Average $H_D$ of heights μm |
|---|---|---|---|---|
| Member 1 for electrophotography | 0.50 | 50 | 2,827 | 5.1 |
| Member 2 for electrophotography | 0.50 | 60 | 3,217 | 4.9 |
| Member 3 for electrophotography | 0.50 | 72 | 3,117 | 4.8 |
| Member 4 for electrophotography | 0.50 | 80 | 2,827 | 5.0 |
| Member 5 for electrophotography | 0.50 | 90 | 2,922 | 5.2 |
| Member 6 for electrophotography | 0.50 | 66 | 302 | 2.0 |
| Member 7 for electrophotography | 0.50 | 72 | 1,001 | 3.5 |
| Member 8 for electrophotography | 0.50 | 65 | 5,027 | 2.0 |
| Member 9 for electrophotography | 0.50 | 69 | 9,993 | 10.0 |
| Member 10 for electrophotography | 0.10 | 74 | 2,827 | 2.0 |
| Member 11 for electrophotography | 1.00 | 73 | 3,019 | 5.0 |
| Member 12 for electrophotography | 0.50 | 70 | 3,019 | 0.5 |
| Member 13 for electrophotography | 0.50 | 70 | 3,019 | 1.0 |
| Member 14 for electrophotography | 0.50 | 80 | 1,963 | 15.0 |
| Member 15 for electrophotography | 0.50 | 80 | 1,590 | 17.0 |
| Member 16 for electrophotography | 0.56 | 70 | 3,019 | 5.4 |
| Member 17 for electrophotography | 0.90 | 70 | 3,019 | 5.3 |
| Member 18 for electrophotography | 3.00 | 70 | 3,019 | 5.3 |
| Member C1 for electrophotography | 4.00 | 72 | 3,117 | 4.9 |
| Member C2 for electrophotography | 0.09 | 77 | 1,963 | 6.0 |
| Member C3 for electrophotography | 0.50 | 92 | 707 | 5.0 |
| Member C4 for electrophotography | 0.50 | 45 | 4,778 | 5.0 |
| Member C5 for electrophotography | 0.50 | 80 | 177 | 1.0 |
| Member C6 for electrophotography | 0.50 | 85 | 13,273 | 5.0 |
| Member C7 for electrophotography | 4.00 | 50 | 3,117 | 4.9 |
| Member C8 for electrophotography | 4.00 | 90 | 3,117 | 4.9 |

TABLE 12

| | Member | Toner charge quantity (μC/g) | Fogging value (%) | Toner conveyance amount (mg/cm$^2$) | Black solid image density difference |
|---|---|---|---|---|---|
| Example 1 | Member 1 for electrophotography | 30 | 2.8 | 0.32 | 0.15 |
| Example 2 | Member 2 for electrophotography | 36 | 2.0 | 0.36 | 0.05 |
| Example 3 | Member 3 for electrophotography | 45 | 0.7 | 0.37 | 0.02 |
| Example 4 | Member 4 for electrophotography | 47 | 1.0 | 0.35 | 0.04 |
| Example 5 | Member 5 for electrophotography | 46 | 0.9 | 0.32 | 0.13 |
| Example 6 | Member 6 for electrophotography | 35 | 2.3 | 0.31 | 0.16 |
| Example 7 | Member 7 for electrophotography | 40 | 0.8 | 0.33 | 0.08 |
| Example 8 | Member 8 for electrophotography | 39 | 1.3 | 0.33 | 0.06 |
| Example 9 | Member 9 for electrophotography | 30 | 2.4 | 0.32 | 0.15 |
| Example 10 | Member 10 for electrophotography | 33 | 3.8 | 0.31 | 0.13 |
| Example 11 | Member 11 for electrophotography | 31 | 3.7 | 0.30 | 0.18 |
| Example 12 | Member 12 for electrophotography | 32 | 3.4 | 0.30 | 0.19 |
| Example 13 | Member 13 for electrophotography | 35 | 2.8 | 0.33 | 0.14 |
| Example 14 | Member 14 for electrophotography | 31 | 2.9 | 0.32 | 0.16 |
| Example 15 | Member 15 for electrophotography | 25 | 3.0 | 0.30 | 0.19 |
| Example 16 | Member 16 for electrophotography | 29 | 3.1 | 0.31 | 0.18 |
| Example 17 | Member 17 for electrophotography | 28 | 4.0 | 0.30 | 0.16 |
| Example 18 | Member 18 for electrophotography | 26 | 4.5 | 0.31 | 0.14 |
| Comparative Example 1 | Member C1 for electrophotography | 18 | 7.0 | 0.30 | 0.15 |
| Comparative Example 2 | Member C2 for electrophotography | 14 | 6.5 | 0.22 | 0.35 |
| Comparative Example 3 | Member C3 for electrophotography | 33 | 3.5 | 0.20 | 0.41 |
| Comparative Example 4 | Member C4 for electrophotography | 17 | 7.1 | 0.27 | 0.21 |
| Comparative Example 5 | Member C5 for electrophotography | 31 | 4.1 | 0.18 | 0.44 |
| Comparative Example 6 | Member C6 for electrophotography | 15 | 7.5 | 0.24 | 0.30 |
| Comparative Example 7 | Member C7 for electrophotography | 15 | 7.5 | 0.33 | 0.10 |
| Comparative Example 8 | Member C8 for electrophotography | 19 | 5.9 | 0.28 | 0.19 |

It is found from Examples 10, 11, and 18, and Comparative Examples 1, 2, 7, and 8 that setting the Martens hardness within the range of the present invention can achieve both a toner-conveying force under high temperature and high humidity, and charge-providing performance for a toner. It is found from Examples 1 to 5, and Comparative Examples 3 and 4 that setting the exposure ratio of the electro-conductive elastic layer within the range of the present invention can achieve both the toner-conveying force under high temperature and high humidity, and the charge-providing performance for the toner. It is found from Examples 6 to 9, and Comparative Examples 5 and 6 that setting the average base area of the electrically insulating domains within the range of the present invention can achieve both the toner-conveying force under high temperature and high humidity, and the charge-providing performance for the toner.

It is found from Examples 3 and 12 to 15 that setting the average $H_D$ of the heights of the electrically insulating domains to 1.0 μm or more and 15.0 μm or less can achieve both the toner-conveying force under high temperature and high humidity, and the charge-providing performance for the toner. It is found from Examples 3 and 16 that setting the number of the electro-conductive elastic layers to two or more can achieve both the toner-conveying force under high temperature and high humidity, and the charge-providing performance for the toner. It is found from Examples 3 and 17 that incorporating the urethane resin into the electro-conductive elastic layer can achieve both the toner-conveying force under high temperature and high humidity, and the charge-providing performance for the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039125, filed Feb. 27, 2015, which is hereby incorporated by reference herein in its entirety.

What is claimed is:

1. A member for electrophotography, comprising:

a substrate;

an electro-conductive elastic layer on the substrate; and a plurality of electrically insulating domains on the electro-conductive elastic layer, wherein:

the electro-conductive elastic layer has a Martens hardness of 0.10 N/mm$^2$ or more and 3.00 N/mm$^2$ or less;

a surface of the member for electrophotography includes at least surfaces of the electrically insulating domains and an exposed portion of the electro-conductive elastic layer not covered with the electrically insulating domains;

a ratio of an area of the exposed portion of the electro-conductive elastic layer to an area of a square 300 μm on a side in the surface of the member for electrophotography is 50% or more and 90% or less; and an average of areas of portions of the respective plurality of electrically insulating domains to be brought into contact with the electro-conductive elastic layer is 300 $\mu m^2$ or more and 10,000 $\mu m^2$ or less.

2. A member for electrophotography according to claim 1, wherein the Martens hardness is 0.10 $N/mm^2$ or more and 1.00 $N/mm^2$ or less.

3. A member for electrophotography according to claim 1, wherein an average of heights of the respective plurality of electrically insulating domains from the portions to be brought into contact with the electro-conductive elastic layer is 1.0 μm or more and 15.0 μm or less.

4. A member for electrophotography according to claim 1, wherein the electro-conductive elastic layer has a laminated structure including two or more layers.

5. A member for electrophotography according to claim 1, wherein the electro-conductive elastic layer contains a urethane resin.

6. An electrophotographic process cartridge, comprising a developing roller, the process cartridge being detachably mountable to a main body of an electrophotographic image forming apparatus, wherein the developing roller is a member for electrophotography comprising:

a substrate;

an electro-conductive elastic layer on the substrate; and a plurality of electrically insulating domains on the electro-conductive elastic layer, wherein:

the electro-conductive elastic layer has a Martens hardness of 0.10 $N/mm^2$ or more and 3.00 $N/mm^2$ or less;

a surface of the member for electrophotography includes at least surfaces of the electrically insulating domains and an exposed portion of the electro-conductive elastic layer not covered with the electrically insulating domains;

a ratio of an area of the exposed portion of the electro-conductive elastic layer to an area of a square 300 μm on a side in the surface of the member for electrophotography is 50% or more and 90% or less; and an average of areas of portions of the respective plurality of electrically insulating domains to be brought into contact with the electro-conductive elastic layer is 300 $\mu m^2$ or more and 10,000 $\mu m^2$ or less.

7. An electrophotographic image forming apparatus, comprising a developing roller, wherein the developing roller is a member for electrophotography comprising:

a substrate;

an electro-conductive elastic layer on the substrate; and a plurality of electrically insulating domains on the electro-conductive elastic layer, wherein:

the electro-conductive elastic layer has a Martens hardness of 0.10 $N/mm^2$ or more and 3.00 $N/mm^2$ or less;

a surface of the member for electrophotography includes at least surfaces of the electrically insulating domains and an exposed portion of the electro-conductive elastic layer not covered with the electrically insulating domains;

a ratio of an area of the exposed portion of the electro-conductive elastic layer to an area of a square 300 μm on a side in the surface of the member for electrophotography is 50% or more and 90% or less; and an average of areas of portions of the respective plurality of electrically insulating domains to be brought into contact with the electro-conductive elastic layer is 300 $\mu m^2$ or more and 10,000 $\mu m^2$ or less.

* * * * *